United States Patent [19]

Brockway

[11] 4,052,984

[45] Oct. 11, 1977

[54] PLENUM TYPE AIR DISTRIBUTION SYSTEM FOR HEAD ENCLOSURE

[75] Inventor: Brock F. Brockway, Mill Valley, Calif.

[73] Assignee: E. D. Bullard Company, Sausalito, Calif.

[21] Appl. No.: 670,190

[22] Filed: Mar. 25, 1976

[51] Int. Cl.[2] ..... A62B 17/04

[52] U.S. Cl. ..... 128/142.7

[58] Field of Search ..... 128/142.7, 142.5, 145 R, 128/142 R; 181/33 P, 33 R, 33 K, 36 A, 50, 71, 56, 39, 36 E, 46, 47 A; 15/326; 55/276; 239/145

[56] References Cited

U.S. PATENT DOCUMENTS

| | | | |
|---|---|---|---|
| 2,485,908 | 10/1949 | Morrow | 128/142 R |
| 2,896,617 | 7/1959 | Gibbons | 128/142.7 |
| 3,123,831 | 3/1964 | Wells et al. | 128/142.7 |
| 3,293,659 | 12/1966 | Shepard | 128/142.7 |
| 3,315,895 | 4/1967 | Klingbeil et al. | 239/145 |
| 3,587,779 | 6/1971 | Beagles et al. | 181/36 R |
| 3,601,219 | 8/1971 | Raschke et al. | 181/36 R |
| 3,874,152 | 4/1975 | Dahl | 56/202 |
| 3,881,478 | 5/1975 | Rosendahl et al. | 128/142.7 |
| 3,896,897 | 7/1975 | Hilbush, Jr. | 181/36 A |
| 3,963,021 | 6/1976 | Bancroft | 128/142.7 |

*Primary Examiner*—Robert W. Michell
*Assistant Examiner*—Henry J. Recla
*Attorney, Agent, or Firm*—Phillips, Moore, Weissenberger, Lempio & Majestic

[57] ABSTRACT

An improved plenum type air distribution system adapted to be mounted in a head protective helmet or hood for distributing respiratation air to the interior of the helmet or hood is described which includes a combination air diffusion and noise attenuation means comprising a porous bladder or air sack connected to an air supply tube. Various materials suitable for use in making the air diffusing and noise attenuating air sack are disclosed and a preferred embodiment of the air sack is described.

11 Claims, 9 Drawing Figures

PLENUM TYPE AIR DISTRIBUTION SYSTEM FOR HEAD ENCLOSURE

BACKGROUND OF THE INVENTION

This invention relates to plenum type air distribution systems for head enclosures of the type worn during sandblasting operations, for example, and more particularly to a combination air diffusing and noise attenuating means for use in such systems.

Health and safety requirements dictate that those working in atmospheres contaminated with airborne substances wear a head enclosing hood the interior of which is supplied with pure respiration air. The respiration air is typically supplied under pressure to the interior volume of the hood through a tube having one or more openings within the hood. However, when a large volume of air under pressure passes through an opening, it will produce a whistle-like sound at an audible level that is particularly bothersome and fatiguing within a head enclosure or hood. Sounds tend to reverberate within an enclosure particularly where the enclosure is rigid and does not include means for damping or attenuating such sounds. Where the enclosure is a head enclosure, a very high noise level within the enclosure is easily achieved by a constant source of sound within the head enclosure.

It is an object of this invention to provide an improved plenum type air distribution system for use within a head enclosure which includes an air diffusion means that not only makes a reduced contribution to the sound present within the head enclosure, but also tends to attenuate sound within the enclosure.

It has been proposed in the prior art to reduce the contribution made by an air distribution system to the sound present within a head enclosure by increasing the number and decreasing the size of openings through which the air passes from the air supply tube to the interior of the head enclosure. This approach has been at least partially successful in that it has reduced the volume of the air flow through any particular opening in direct proportion to the number of such openings and inverse proportion to their size. However, it also has the tendency to merely raise the frequency of the sound above the audible range unless the openings are very small and numerous indeed. Sounds which are barely above the audible range can still produce harmful effects although the wearer of the helmet is not aware of such sounds.

It is a further object of this invention to provide an improved plenum-type air distribution system for use within a head enclosure in which the number of openings for the passage of air into the head enclosure is greatly increased and the size of such openings are reduced toward minimum to thereby reduce the amplitude and wavelengths of any sounds produced by such system toward minimum.

It is yet another object of this invention to provide an air distribution system of the type described which also includes means for attenuating sound within the head enclosure.

It is a still further object of this invention to provide an air distribution system of the type described having the above-mentioned advantages with little increase in the complexity and cost of the air distribution system.

SUMMARY OF THE INVENTION

Briefly, this invention provides apparatus for distributing air and attenuating sound within an enclosure such as a head enclosure or hood which apparatus comprises a microporous elastomeric air sack defining a substantially closed volume and means for supplying air under pressure to such substantially closed volume. The air sack has walls with an exterior area that is a substantial portion of the area of the interior walls of the enclosure. Thus, air is diffused into the enclosure only through the micropores of the elastomeric air sack and sound present within the enclosure is attenuated by the walls of the air sack.

BRIEF DESCRIPTION OF THE DRAWING

The foregoing and other objects and features of advantage of this invention will be more clearly understood from a reading of the following specification with reference to the accompanying drawing wherein.

DESCRIPTION OF PREFERRED EMBODIMENTS

Figure 1:
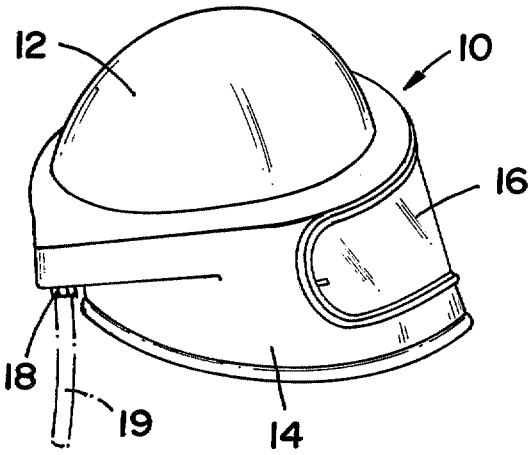
FIG. 1 is a perspective view of a head enclosing helmet to which this invention may be applied with advantage.

Referring to FIG. 1, a head enclosure in the form of a helmet 10 to which this invention may be applied with advantage, is shown in perspective. The helmet 10 is made of a rigid material such as heavy gauge plastic having appropriate structural strength and hardness, for example, and includes a head protective portion 12 and a face mask portion 14 designed to fully enclose the head and face of the wearer. A transparent or translucent protective lens 16 is provided in the face mask portion 14 of the helmet 10 opposite the face of the wearer for optical purposes and to protect the eyes of the wearer.

In order to provide respiration air for the wearer of the helmet 10, a plenum type air distribution means is provided within the interior of the helmet 10 and a fitting 18 in communication therewith is provided on the exterior of the helmet 10. Thus, an air supply tube or hose, as indicated in dotted lines in FIG. 1, may be connected to the fitting 18 to provide a positive pressure of pure respiration air within the helmet 10. Such a plenum type air distribution system within the helmet 10 will not only insure that the wearer will have a constant supply of fresh air but will also prevent the entry into the helmet of air contaminated by airborne substances from the surrounding atmosphere as when the helmet 10 is worn during sandblasting operations, for example.

Figure 2:
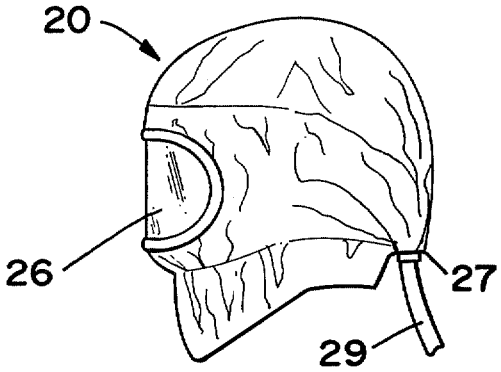
FIG. 2 is a side view in elevation of a head enclosing hood to which the teaching of this invention may be applied with advantage.

Referring to FIG. 2, the teaching of this invention is also applicable to head enclosures in the form of a flexible hood 20. As shown in FIG. 2, the flexible hood 20 is designed to completely enclose the head and neck of the wearer and is provided with an appropriate protective lens 26 in the wall thereof adapted to be disposed in front of the face of the wearer.

Figure 7:
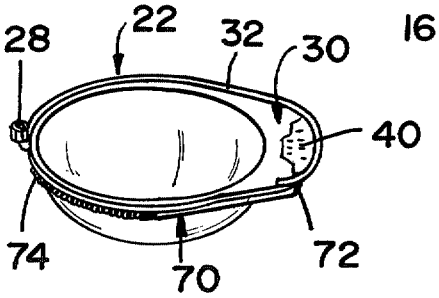
FIG. 7 is a perspective view of a helmet designed to only partially enclose the head of the wearer with the improved plenum type air distribution system according to the embodiment of this invention shown in FIG. 3 mounted thereon, the helmet of FIG. 7 being shown in inverted position and being of the type typically used with the head enclosing hood of FIG. 2.

A rigid head protective cap or "hard hat" 22, as shown in inverted position in FIG. 7 is worn under the flexible hood 20 to protect the head of the wearer against impact. Thus, as also shown in FIG. 7, the plenum type respiration air distribution system including a fitting 28 or connection to an air supply hose may be mounted on the hard hat 22. As shown in FIG. 2, the hood 20 is provided with an appropriate seal 27 through which the hose 29 is received for connection to the fitting 28. By this means, a plenum type supply of respiration air is provided within the hood 20.

Figure 3:
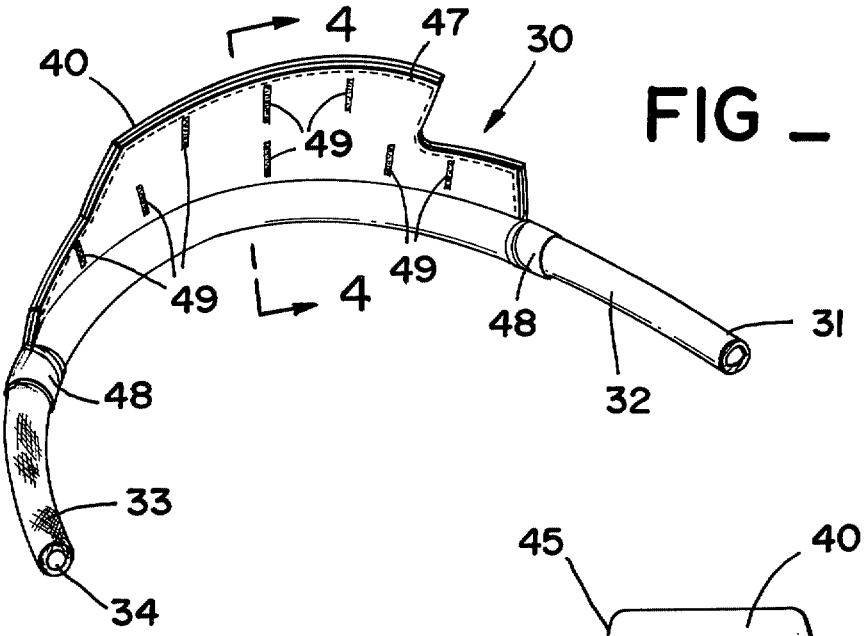
FIG. 3 is an enlarged perspective view of the air diffusion and noise attenuation means according to the teaching of this invention with a fragmentary showing of an air supply tube connected thereto.

Referring to FIG. 3, an enlarged fragmentary perspective view of a preferred embodiment 30 of a plenum type air distribution system in accordance with the teaching of this invention is shown. This embodiment 30 comprises an air distribution tube 32, one end 31 of which terminates in a fitting 18, 28 as shown in FIGS. 1 and 7 but not shown in FIG. 3. The other end 33 of the air distribution tube 32 is closed by a plug 34.

Figure 4:
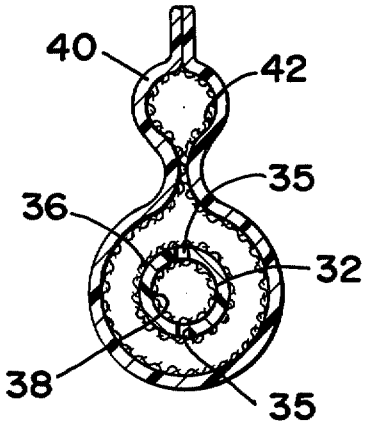
FIG. 4 is a cross-sectional view taken along lines 4—4 of FIG. 3.

As best shown in FIG. 4, a portion of the air distribution tube 32 intermediate its ends is provided with a plurality of openings 35 through the wall thereof to enable the escape of air supplied to the tube 32 by an air supply hose 19, 29. The air supplied through the hose 19, 29 must be at a pressure substantially above atmospheric in order to enable the provision of a plenum type of respiration air supply within the helmet 10 or hood 20.

It has been found in the prior art that when high pressure air passes through an opening such as the openings 35 in the air distribution tube 32, a whistle-like sound will tend to be produced which is both bothersome and fatiguing and if it is of sufficient amplitude, may actually result in damage to the ears of the wearer. The amplitude of the sound produced is a direct function of the volume of air flow through the opening 35 and the wavelength of the sound produced is a direct function of the size of the aperture 35. Thus, in the prior art, it has been proposed to reduce both the amplitude and the wavelength of the sound by decreasing the size of the openings 35 and increasing the number thereof. However, in view of the total air flow required to maintain the plenum type air distribution system this approach has in the past resulted in expensive structures sometimes involving the passage of the air through a container of particulate matter, for example.

More recently, a substantial improvement has been achieved by lining both the interior and the exterior of the air distribution tube 32 with tubular members of woven fabric. This structure is utilized in the preferred embodiment of this invention as shown in FIGS. 3 and 4 wherein the tubular member of woven fabric on the exterior of the air distribution tube 32 is shown generally at 36 and the tubular member of woven fabric lining the interior of the air distribution tube 32 is shown generally at 38. However, such structure may still produce sound at very short wavelengths (i.e., frequencies above the audible range) that may have an amplitude sufficient to be fatiguing or harmful even though the wearer is not aware of such sound. According to the teaching of this invention, any such sound that may be produced is reduced toward minimum by a means which also serves to attenuate any sound that may be present within the head enclosure. As is well known, sound tends to reverberate particularly within a rigid enclosure as represented by the helmet 10 by bouncing between the hard surfaces of the walls thereof and where a constant source of sound is present within such enclosure, very high noise levels may result.

Thus, according to the teaching of this invention, an enlarged bladder or air sack 40 is provided about the intermediate portion of the air distribution tube 32 to receive therewithin the air escaping through the openings 35 in the air distribution tube 32. The air sack 40 is made of a microporous elastomeric material (preferably plastic) and defines a substantially closed volume having walls with an exterior area that is a substantial portion of the area of the interior walls of the head enclosure. According to the preferred embodiment of this invention, the elastomeric plastic is provided with a knit or stretch fabric backing as indicated at 42 in FIG. 4. However, it would also be possible to bond a foamed plastic backing to an elastomeric material in forming the air sack.

Figure 8:
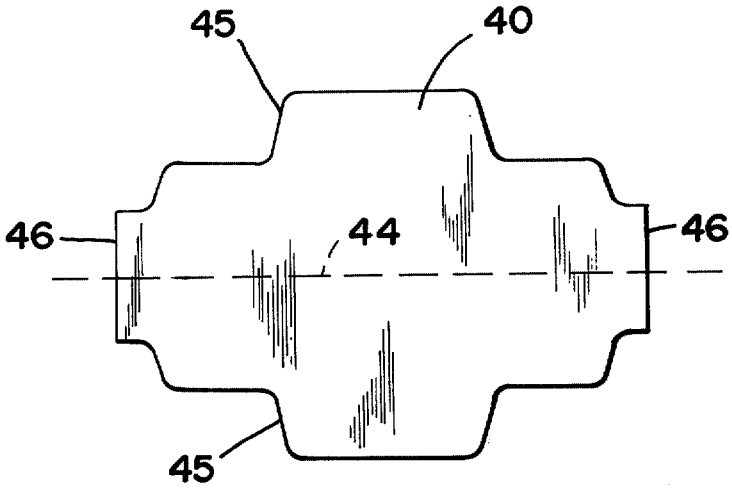
FIG. 8 is a plan view of a piece of elastomeric plastic material shaped to be assembled with an air tube to form the air sack of the preferred embodiment of this invention shown in FIG. 3.

The air sack 40 may be conveniently made by cutting the elastomeric plastic material and backing into a blank as best shown in FIG. 8. Such blank 40 is then folded in half along a line as indicated by the dotted line 44 in FIG. 8 and sewed or hemmed together along its opposite sides 45, leaving the ends 46 thereof open to receive the air distribution tube 32 as shown by the stitches 47 in FIG. 3. The air distribution tube 32 is then inserted through the ends of the air sack 40 and the ends of the air sack are sealed to the air tube 32 as by means of taping indicated generally at 48 in FIG. 3.

When air under pressure is supplied to the air distribution tube 32 and through the openings 35 to the interior of the air sack 40, such air sack 40 will tend to expand in the nature of a balloon as best shown in FIG. 4. In order to avoid excessive expansion of the air sack 40 into an over-size pillow-like shape, a plurality of "bartacks" 49 through the walls of the air sack 40 are preferably provided as shown in FIG. 3.

Figure 5:
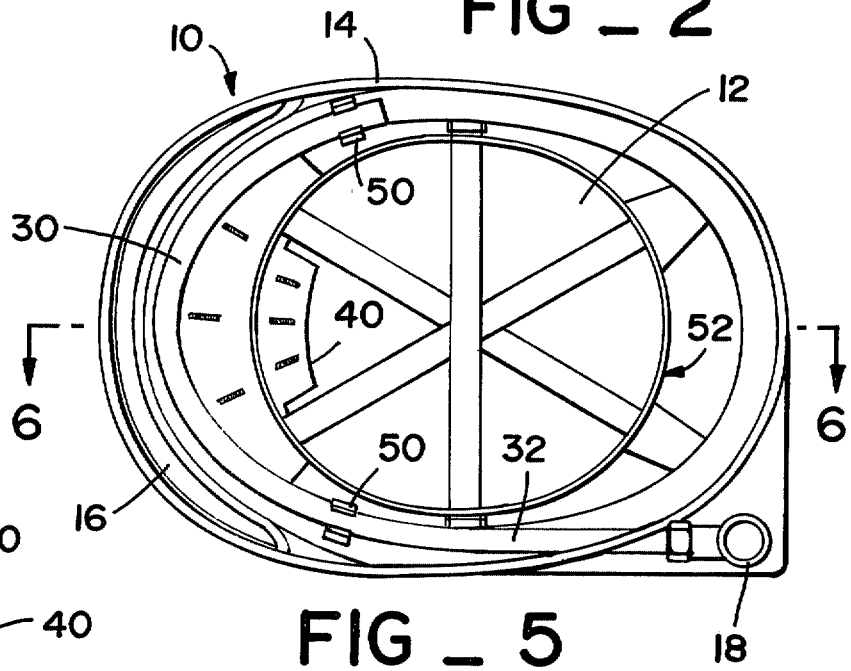
FIG. 5 is a bottom view in elevation of the head enclosing helmet of FIG. 1 with the improved plenum type air distribution system according to the embodiment of this invention shown in FIG. 3 mounted therein.
Figure 6:
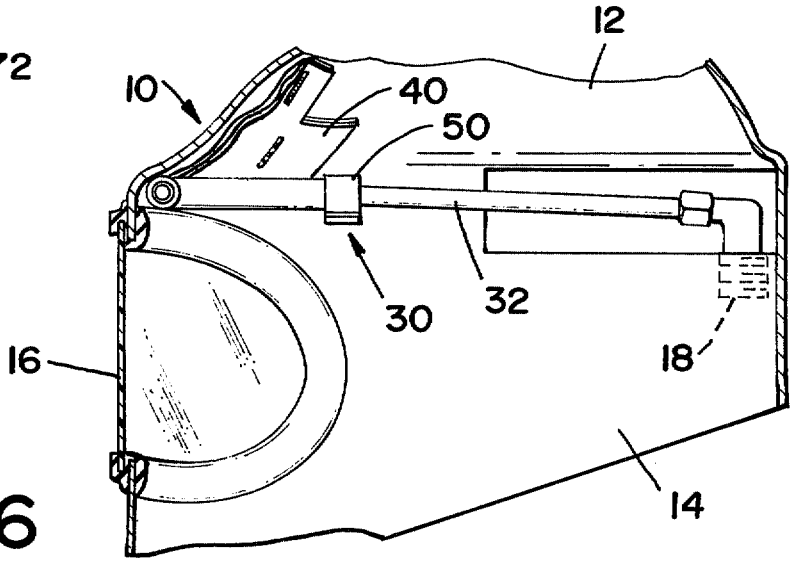
FIG. 6 is a fragmentary cross-sectional view taken along line 6—6 of FIG. 5.

Air under pressure within the air sack 40 will be diffused therefrom through the knit or stretch fabric backing and the micropores of the elastomeric plastic material. Referring to FIGS. 5 and 6, the plenum type air distribution system according to the embodiment 30 of this invention shown in FIG. 3, may be conveniently mounted within a helmet 10 as shown in FIG. 1 by means of clips 50, for example, provided in the interior thereof. As best shown in FIG. 5, the embodiment 30 is mounted so that the air sack 40 extends upwardly along the interior surface of the head protective portion 12 of the helmet 10 directly over the protective lens 16 in the face mask portion 14 of the helmet 10 so that pure respiration air is provided adjacent the face and nose of the wearer. This will also position the air sack 40 in a desirable location within the helmet 10 for the attenuation of sounds which are present in or enter the interior of the helmet 10. The location of the air sack 40 above the fitting straps 52 which actually engage the head of the wearer and between such fitting straps 52 and the interior of the head protective portion 12 of the helmet prevents it from interfering in any way with the comfort of the helmet 10 to the wearer.

Referring to FIG. 7, the embodiment 30 of this invention may also be conveniently mounted on a hard hat 22 by means of a more or less conventional structure 70 including a bill engaging frame 72 and a tension spring 74 provided with appropriate clamps for engaging the air distribution tube 32. As shown in FIG. 7, the air sack 40 may be conveniently positioned along the surface of the bill of the hard hat 22 directly over the face of the wearer.

Referring again to FIG. 4, the air sack 40 will attenuate any sounds produced by the passage of air through the openings 35 in the air distribution tube 32 in addition to attenuating sounds which may impinge thereon from the outside. The air sack may be made of a variety of materials including sintered vinyl of the type commercially available under the trademark "PORON" or a foamed vinyl on a knit backing, stretch fabric backing, nonwoven fabric backing or foam backing. In the preferred embodiment of this invention, the air sack 40 is made of a perforated "expanded vinyl" on a cotton knit backing of the type supplied commercially by Uniroyal.

It is possible that a small amount of air will diffuse through the sewn or hemmed interface produced when the sack 40 is formed. However, it has been found that substantially all of the air escaping from the air sack 40 will be diffused through the micropores in the elastomeric plastic material. Due to the great number of such pores and their extremely small size, the amplitude of any sound produced by the passage of air through such pores, as well as the wavelength of any such sound, will tend to be reduced toward minimum.

Figure 9:
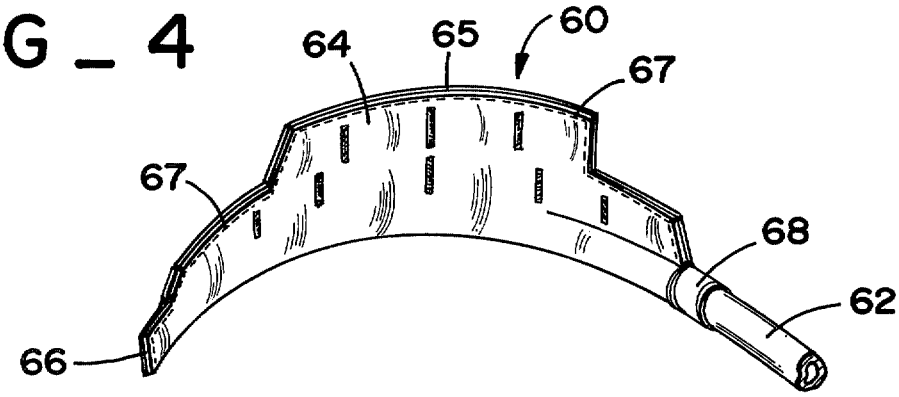
FIG. 9 is an enlarged perspective view of the improved plenum type air distribution system according to a further embodiment of this invention.

Referring to FIG. 9, an embodiment 60 of this invention is shown in which the air distribution tube 62 does not extend through the air sack 64. Instead, the left hand end 66 of the air sack 64 as well as the sides 65 is closed by the stitches 67 and the air distribution tube 62 terminates a short distance after being sealed within the right hand end of the air sack 64 by an appropriate sealing tape 68. Thus, the entire distribution of air is accomplished by diffusion through the micropores of the air sack 64 and any sound that may result due to the passage of air from the tue 62 into the air sack 64 will tend to be attenuated within the air sack 64. Appropriate mounting means would, of course, be required for supporting the air sack 64 when no air is being supplied thereto but when the air sack 64 is extended by the presence of air under pressure therewithin, it will tend to be self-supporting as shown in FIG. 9.

The air sack 40, 64 may be formed as an integral whole, rather than by folding and stitching as described hereinabove. Also, other forms of bonding at the edges of the folded blank may be used in place of the stitching, such as fusion bonds formed by heat, for example.

From the above it will be seen that a simple, inexpensive and highly effective means for diffusing air within an enclosure which also serves to attenuate sound within such enclosure has been provided. The specific shape of the air sack as shown in the drawing may be changed to suit a particular enclosure, however, according to this invention, the air sack must have an external area which is a substantial portion of the internal area of the enclosure in order to provide adequate air flow in comparison to the volume of the enclosure and to provide a useful noise attenuation function.

It has been found that an air sack made of a blank as shown in FIG. 8 where the blank had a length of about 24 cm between its ends and a maximum width of about 16 cm between its sides can handle an air flow of 6 cu ft. (0.28 $m^3/s$) per minute through an air distribution tube having an inner diameter of about 1 cm without producing an objectionable noise level and in fact air flows as high as 15 cu ft (0.7 $m^3/s$) per minute were possible without exceeding the maximum noise level of 80 decibles prescribed by Government regulation. It is believed that those skilled in the art will make obvious changes in the embodiments of this invention as shown in the drawing and described hereinabove in order to obtain the advantages of this invention in specific situations.

What is claimed is:

1. In combination, a head protective enclosure and apparatus for distributing air and attenuating sound within said enclosure comprising a microporous elastomeric air sack defining a substantially closed volume having walls with an exterior area that is a substantial portion of the area of the interior walls of said enclosure and means for supplying air under pressure to said substantially closed volume whereby air is diffused only through the micropores of said elastomeric air sack and sound is attenuated by the walls of said air sack and wherein said means for supplying air under pressure to said substantially closed volume comprises a tube extending within said volume and having an opening within said volume.

2. The combination as claimed in claim 1 wherein said means for supplying air under pressure to said substantially closed volume comprises a rigid tube extending through said volume and having openings through the wall thereof within said volume.

3. The combination as claimed in claim 1 wherein said elastomeric air sack has a fabric backing on the interior surface thereof.

4. The combination as claimed in claim 3 wherein said fabric backing is of knit construction.

5. The combination as claimed in claim 3 wherein said fabric backing is of woven stretch fabric construction.

6. The combination as claimed in claim 3 wherein said air sack is made of a sintered vinyl bonded to said fabric backing.

7. The combination as claimed in claim 3 wherein said air sack is made of a foamed vinyl bonded to said fabric backing.

8. The combination as claimed in claim 3 wherein said air sack is made of a vinyl sheet expanded by perforating and bonded to said fabric backing.

9. The combination as claimed in claim 8 wherein said fabric backing is of cotton knit construction.

10. The combination as claimed in claim 9 wherein said air sack comprises a single sheet of said elastomeric plastic with said fabric backing which is folded and bonded together along edges thereof and at spaced points of the area thereof to form a tufted pillow-like sack.

11. The combination as claimed in claim 1 wherein said elastomeric air sack has a backing of foamed plastic on the interior surface thereof.

* * * * *